US005862522A

United States Patent [19]

Cho

[11] Patent Number: 5,862,522

[45] Date of Patent: Jan. 26, 1999

[54] METHOD AND DEVICE FOR SHAPING THE VISORS OF CAPS AND SUCH A CAP

[75] Inventor: Byoung-Woo Cho, Seoul, Rep. of Korea

[73] Assignee: Yupoong & Co., Ltd., Seoul, Rep. of Korea

[21] Appl. No.: 975,510

[22] Filed: Nov. 21, 1997

[30] Foreign Application Priority Data

Oct. 1, 1997 [KR] Rep. of Korea ..... 97-50748

[51] Int. Cl.[6] ..... A42C 1/06

[52] U.S. Cl. ..... 2/195.1; 223/14; 223/51

[58] Field of Search ..... 2/10, 12, 175.1, 2/175.5, 195.1, 195.6; 223/51, 84, 12, 14; 8/149.3; 68/5 R, 6, 222

[56] References Cited

U.S. PATENT DOCUMENTS 1,732,767 10/1929 Murphy ..... 223/51

5,732,858 3/1998 Plastino ..... 223/12

*Primary Examiner*—Diana L. Biefeld

*Attorney, Agent, or Firm*—Harrison & Egbert

[57] ABSTRACT

A method and device for shaping the visors of caps is disclosed. In the method, the visor is curved into a predetermined curvature prior to being heated by hot steam having a temperature of about 100° C. for about 5–150 seconds. The heated visor is cooled by a cool air current having a temperature of about 5°–25° C. for about 10–150 seconds. The device has heating and cooling units respectively connected to hot steam and cool air sources. A plurality of molds, used for shaping the visors, are received in at least one of the two units. Each of the molds includes two perforated panels, which are curved into the curvature and are assembled into a single body, with a plurality of spacers being interposed between the two panels and spacing the two panels apart from each other while def ining a curved gap between the two panels for receiving the visor of a cap.

2 Claims, 14 Drawing Sheets

31
30
10
33
36
34
32
33'
36
22
20
22
20
14
14'
13

METHOD AND DEVICE FOR SHAPING THE VISORS OF CAPS AND SUCH A CAP

FIELD OF THE INVENTION

The present invention relates, in general, to a method and device for shaping the visors of caps and, more particularly, to a method and device for thermally curving such a visor into a predetermined curvature using hot steam and setting the curved configuration of the visor using cool air current.

DESCRIPTION OF THE PRIOR ART

As well known to those skilled in the art, a cap is a soft, light hat, which has a curved visor protruding at the front and is worn on the head, thus giving protection from rain, snow and strong light from the sun. Several types of caps, classified in accordance with their use, are known. Some people use such caps as accessories for decorative purpose or showing one's marked individuality.

As shown in FIG. 1, a typical cap 1 is comprised of a dome-shaped crown 2, which is made of natural or synthetic fiber cloth. A stiff visor 4, which is formed into a predetermined shape using a hard synthetic resin, protrudes at the front of the crown 2.

Such a visor 4 is typically and closely covered with cloth prior to being sewn to the front of the crown 2.

When the above cap 1 is worn on the head, the visor 4 is manually shaped into a curvature by a user, thus allowing the cap 1 to closely fit to the head and give protection from strong light from sun.

However, such a stiff visor is made of a hard synthetic resin, thus being problematic in that it is not easy to shape the visor into a desired curvature and to maintain the desired curvature. That is, the stiff visor easily restores its original flat shape due to the elasticity of its hard synthetic resin material and requires repeatedly shaping into the desired curvature, thereby being inconvenient to users.

SUMMARY OF THE INVENTION

Accordingly, the present invention has been made keeping in mind the above problems occurring in the prior art, and an object of the present invention is to provide a method and device for thermally curving the visor of a cap into a predetermined curvature using hot steam and setting the curved configuration of the visor using cool air current.

Another object of the present invention is to provide such a visor.

In one embodiment, the present invention provides a method of shaping the visor of a cap, comprising the steps of: curving the visor into a predetermined curvature prior to heating the curved visor using hot steam having a temperature of about 100° C. for about 5–150 seconds; and cooling the heated visor using a cool air current having a temperature of about 5°–25° C. for about 10–150 seconds, thus setting the curved configuration of the visor.

In another embodiment, the present invention provides a device for shaping the visors of caps, comprising: a hot steam source and a cool air source; a heating unit being opened at its top and having a steam inlet at a side wall, thus being connected to the hot steam source through the steam inlet; a cooling unit being opened at its top and having a cool air inlet at a side wall, thus being connected to the cool air source through the cool air inlet; a plurality of visor shaping molds used for curving the visors into a predetermined curvature, the molds being received in at least one of the heating and cooling units and being individually comprised of: two perforated panels curved into the curvature and flanged at each side edge, the two perforated panels being assembled with each other at their flanged edges, with a plurality of spacers being interposed between the flanged edges of the two panels and spacing the two panels apart from each other while defining a curved gap between the two panels for receiving the visor of a cap.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
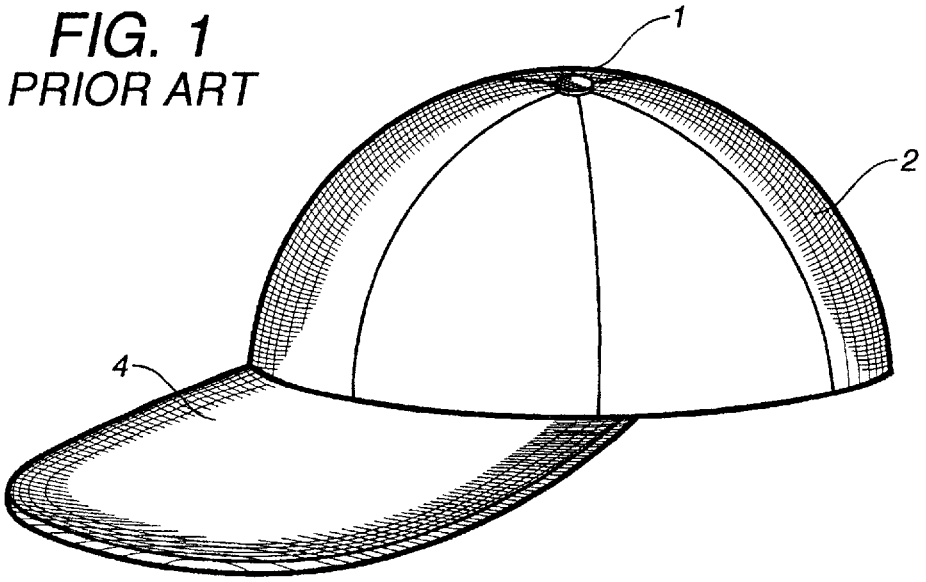
FIG. 1 PRIOR ART
FIG. 1 is a perspective view showing the construction and configuration of a typical cap.
Figure 2:
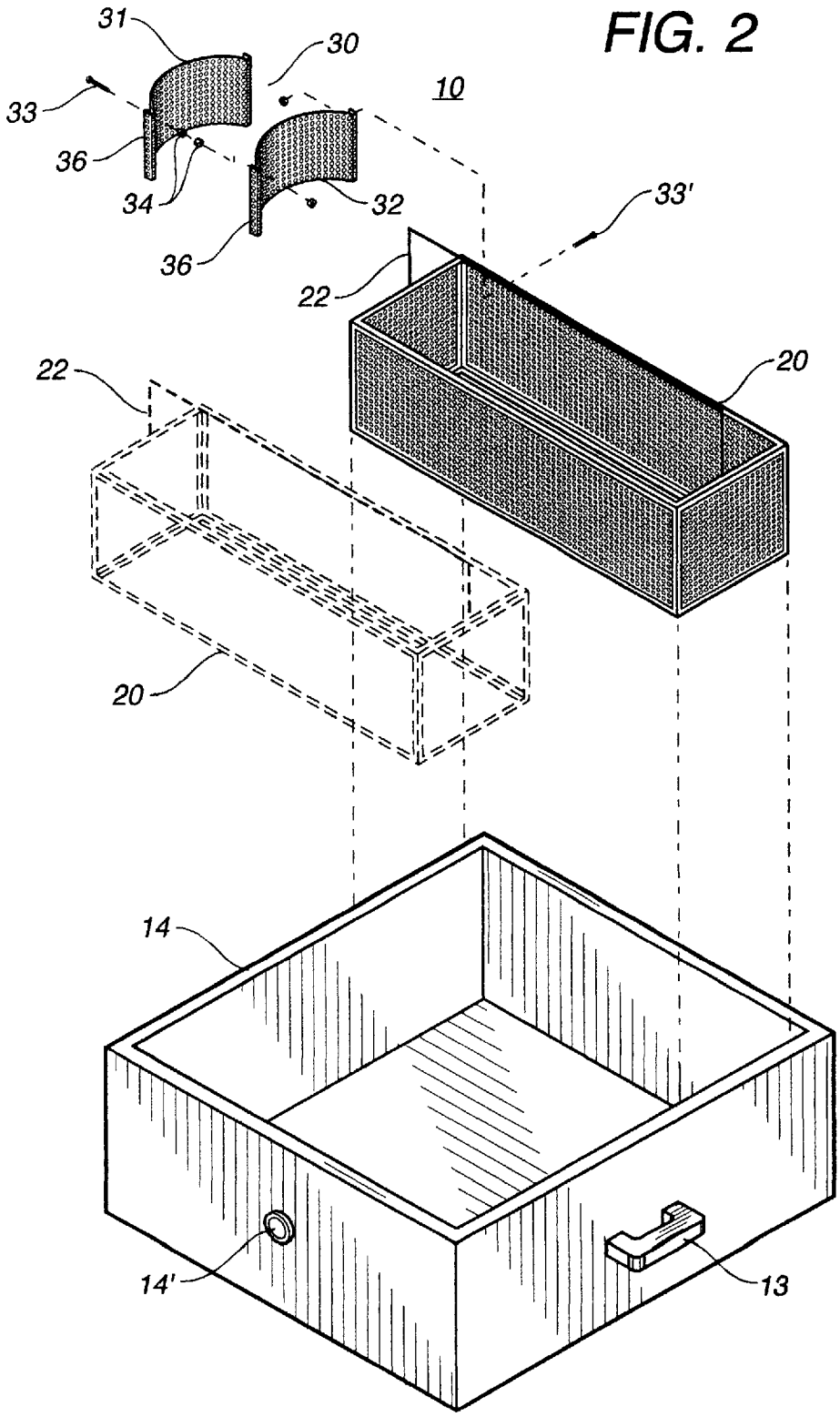
FIG. 2 is an exploded perspective view of a part of the shaping device in accordance with the primary embodiment of the present invention, showing a heating unit and a visor shaping mold case.
Figure 3:
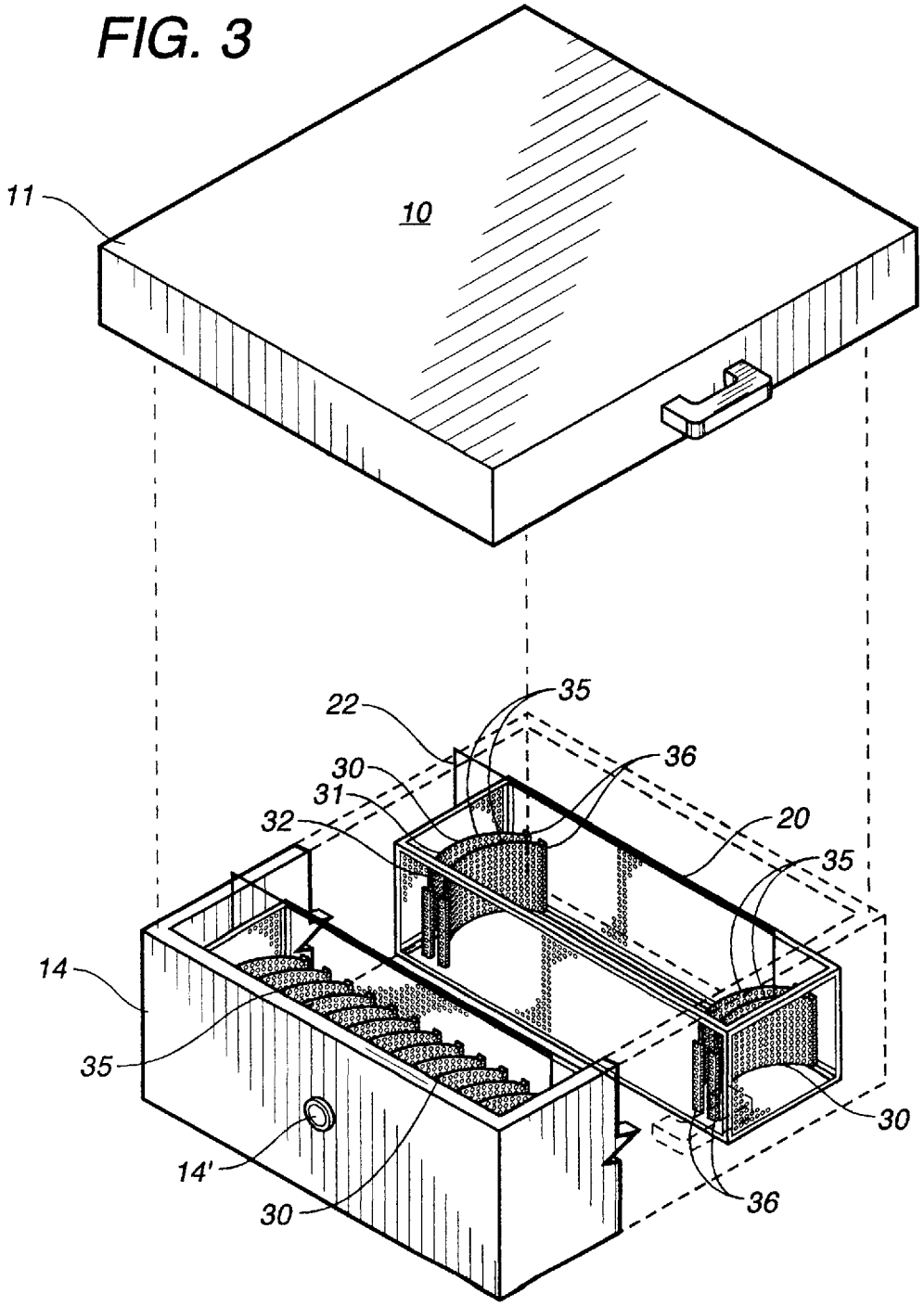
FIG. 3 is a perspective view of the heating unit of FIG. 2, with two mold cases having a plurality of visor shaping molds and being received in the unit and a lid covering the top of the unit.
Figure 4:
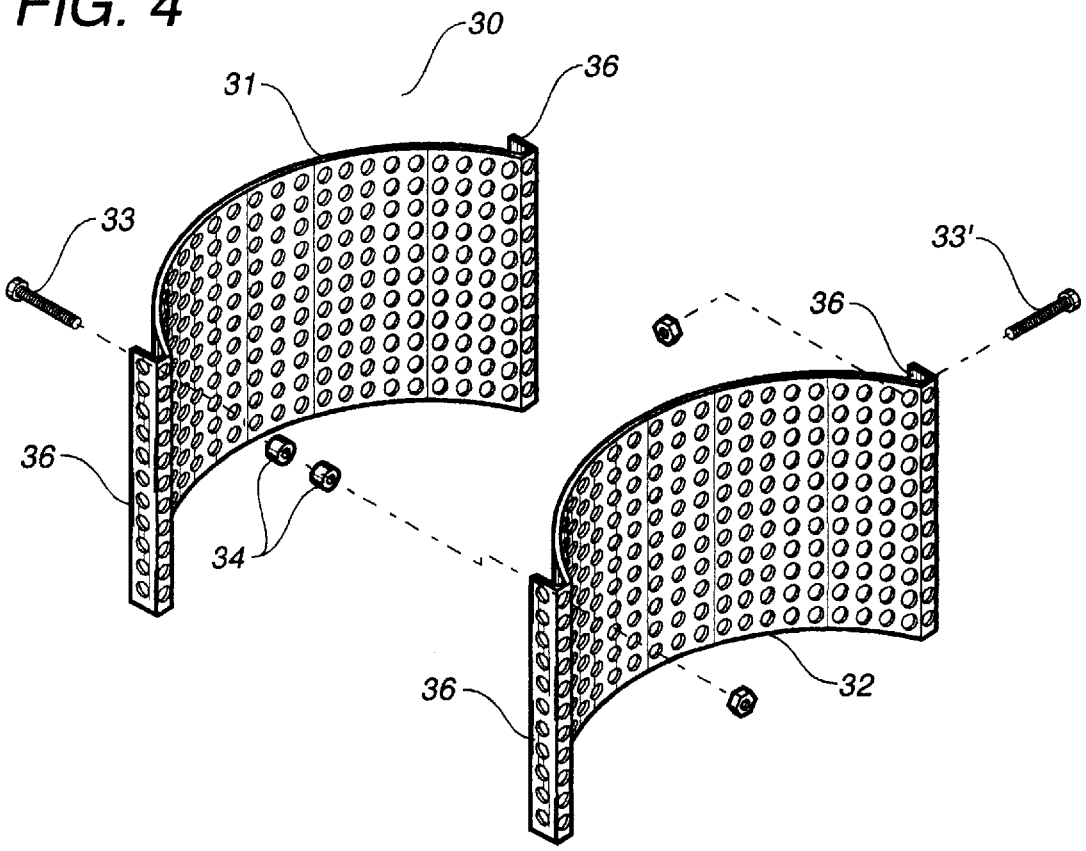
FIG. 4 is an exploded perspective view showing the construction of the visor shaping mold included in the device of FIG. 2.

FIGS. 2 to 6 show the construction and operation of a shaping device in accordance with the primary embodiment of the present invention. As shown in the drawings, the shaping device 10 of this invention curves the visors 4 of caps 1 into a predetermined curvature prior to heating the curved visors 4 using hot steam, having a temperature of about 100° C., for about 5–150 seconds at a heating unit 14, and cools the heated visors 4 using a cool air current, having a temperature of about 5°–25° C., for about 10–150 seconds at a cooling unit 18, thus setting the curved configuration of the visors 4. In the visor shaping device 10 according to the primary embodiment of this invention, the heating unit 14, which is open at its top, has a steam inlet 14' at a side wall, thus being connected to a hot steam source 12 through the inlet 14'. Meanwhile, the cooling unit 18, which is open at its top, has a cool air inlet 18' at a side wall, thus being connected to a cool air source 16. The two sources 12 and 16 respectively supply hot steam and cool air into the two units 14 and 18 through the inlets 14' and 18'. Two longitudinal box-shaped cases 20 are laid in each of the two units 14 and 18 and are freely removable from each unit 14 and 18. The two longitudinal box-shaped cases 20 individually have a handle 22, with both ends of the handle 22 being hinged to the top centers of opposite side walls of each case 20. In each of the two cases 20, the four side walls and the bottom wall except for the top are formed by perforated panels. A plurality of visor shaping molds 30, individually comprised of first and second panels 31 and 32, are regularly arranged along the longitudinal direction in each of the two cases 20. In each of the visor shaping molds 30, the first and second panels 31 and 32, which are individually perforated and curved into a predetermined curvature and have a flange 36 at each side edge, are assembled with each other at their flanges 36 using a plurality of first set screws 33. A plurality of spacers 34 are interposed between the flanged edges of the two panels 31 and 32 and are held by the screws 33, thus spacing the two panels 31 and 32 apart from each other while defining a curved gap 35 between the two panels 31 and 32. After the two panels 31 and 32 are assembled into a visor shaping mold 30, the shaping mold 30 is seated into and fixed to the case 20 at a predetermined position by a plurality of second set screws 33'. In such a case, the visor shaping molds 30 in each of the cases 20 are spaced out at regular intervals.

In the operation of the shaping device of this invention, it is required to maintain the temperature of the hot steam at about 100° C. However, the heating time, cooling temperature and cooling time during the operation of the device may be individually and appropriately changed within an effective range in accordance with both the size of the two units 14 and 18 and the number of caps 1 received in the cases 20.

Figure 5:
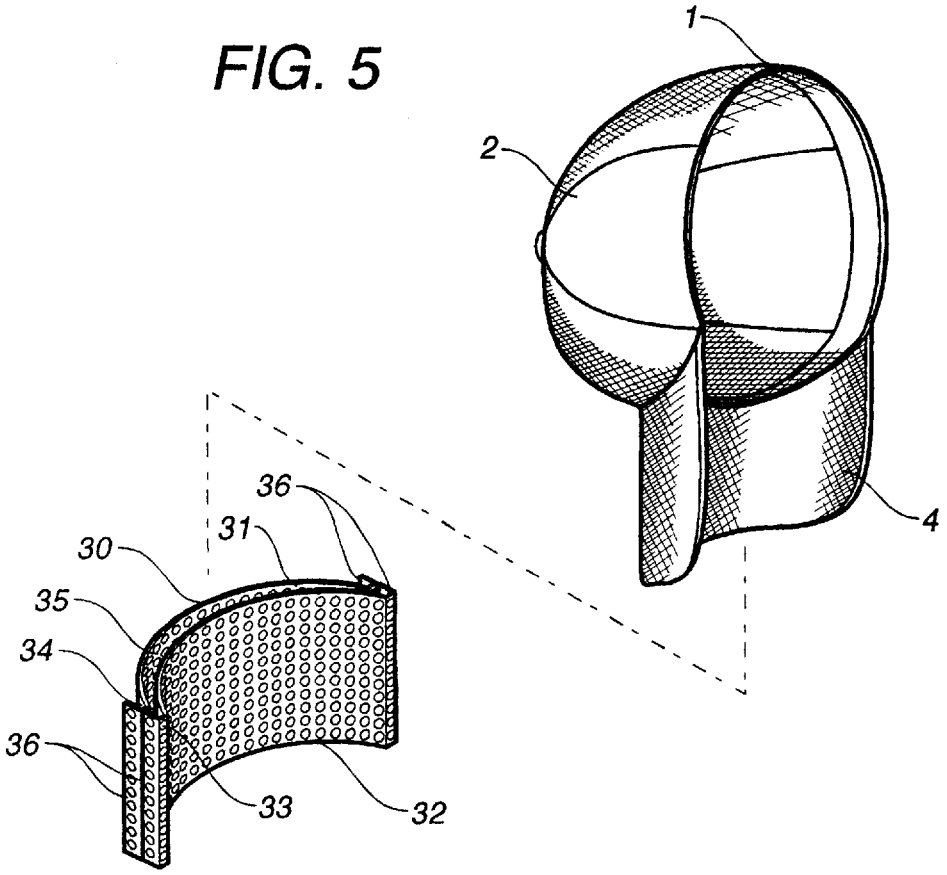
FIG. 5 is a view showing both the visor shaping mold included in the device of FIG. 2 and a cap with the visor being shaped into a predetermined curvature by the mold.

FIG. 5 is an exploded perspective view showing one of the visor shaping molds 30 according to the primary embodiment and a cap 1 with the visor 4 being shaped by the above visor shaping mold 30. As shown in the drawing, the visor 4 of a cap 1 is inserted into the curved gap 35 between the two panels 31 and 32 of the mold 30, which is received in a case 20 of the heating unit 24. The mold 30 is, thereafter, heated by hot steam, thus thermally curving the visor 4 into a desired curvature. The heated case 20 is moved from the heating unit 14 into the cooling unit 18 prior to cooling the mold 30 using cool air current, thus setting the curved configuration of the visor 4.

Figure 6:
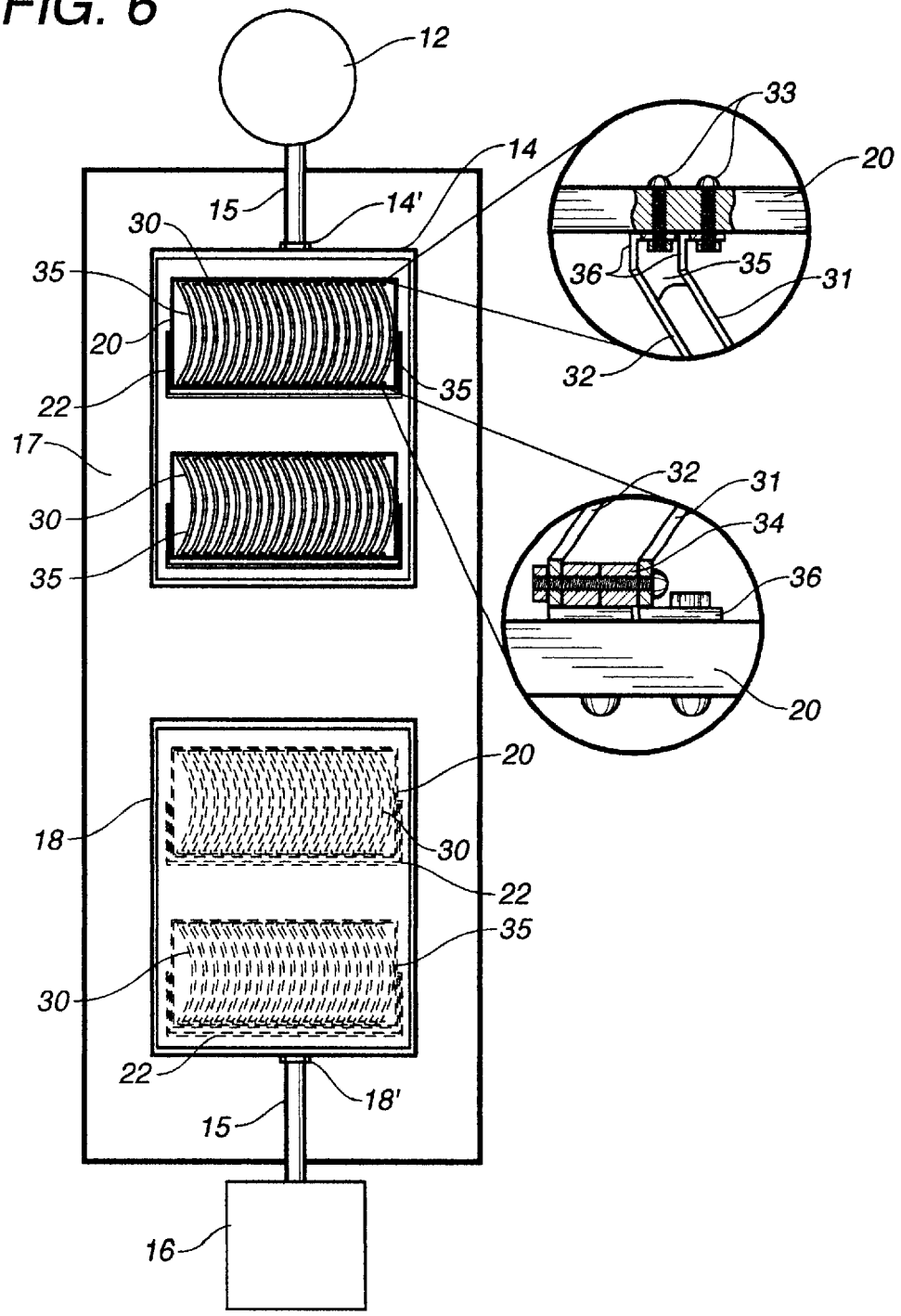
FIG. 6 is a plan view showing the construction of the shaping device of FIG. 2.

FIG. 6 is a plan view of the shaping device according to the primary embodiment. As shown in the drawing, two cases 20, with the visor shaping molds 30 being regularly arranged along the longitudinal direction in each of the cases 20, are laid in the heating unit 14. A plurality of caps 1 are set in the molds 30 of each of the cases 20, with the visors 4 being inserted into the curved gaps 35 of the molds 30. After the caps 1 are completely set in the cases 20, hot steam is supplied from the hot steam source 12 to the heating unit 14, thus thermally shaping the visors 4 into a predetermined curvature. After the heating process, the heated cases 20 are moved from the heating unit 14 into the cooling unit 18 prior to cooling the molds 30 using cool air current, thus setting the curved configuration of the visors 4. In the cooling process, the cool air current is supplied from the cool air source 16.

Figure 7:
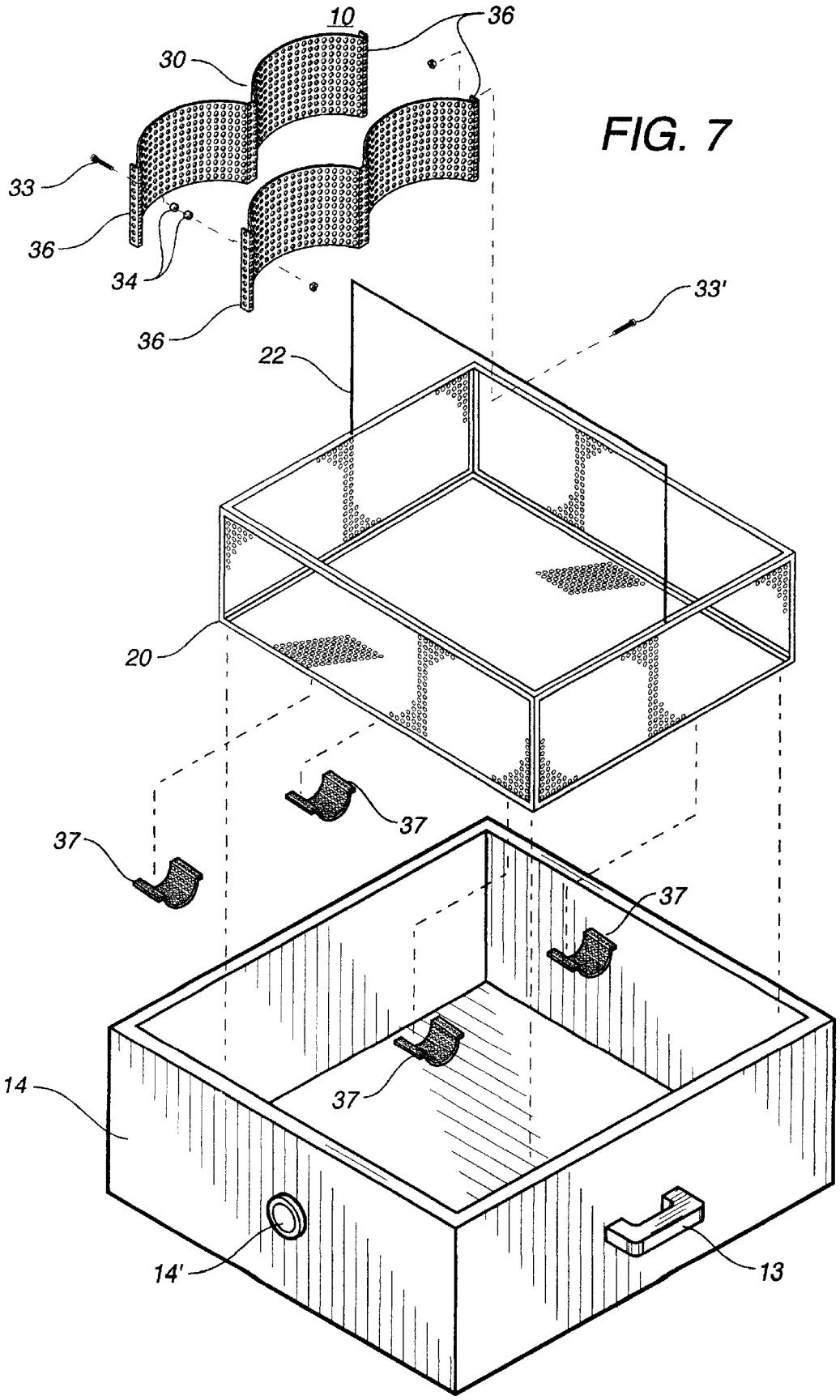
FIG. 7 is an exploded perspective view of a part of the shaping device in accordance with the second embodiment of the present invention, showing a heating unit and a visor shaping mold case.
Figure 8:
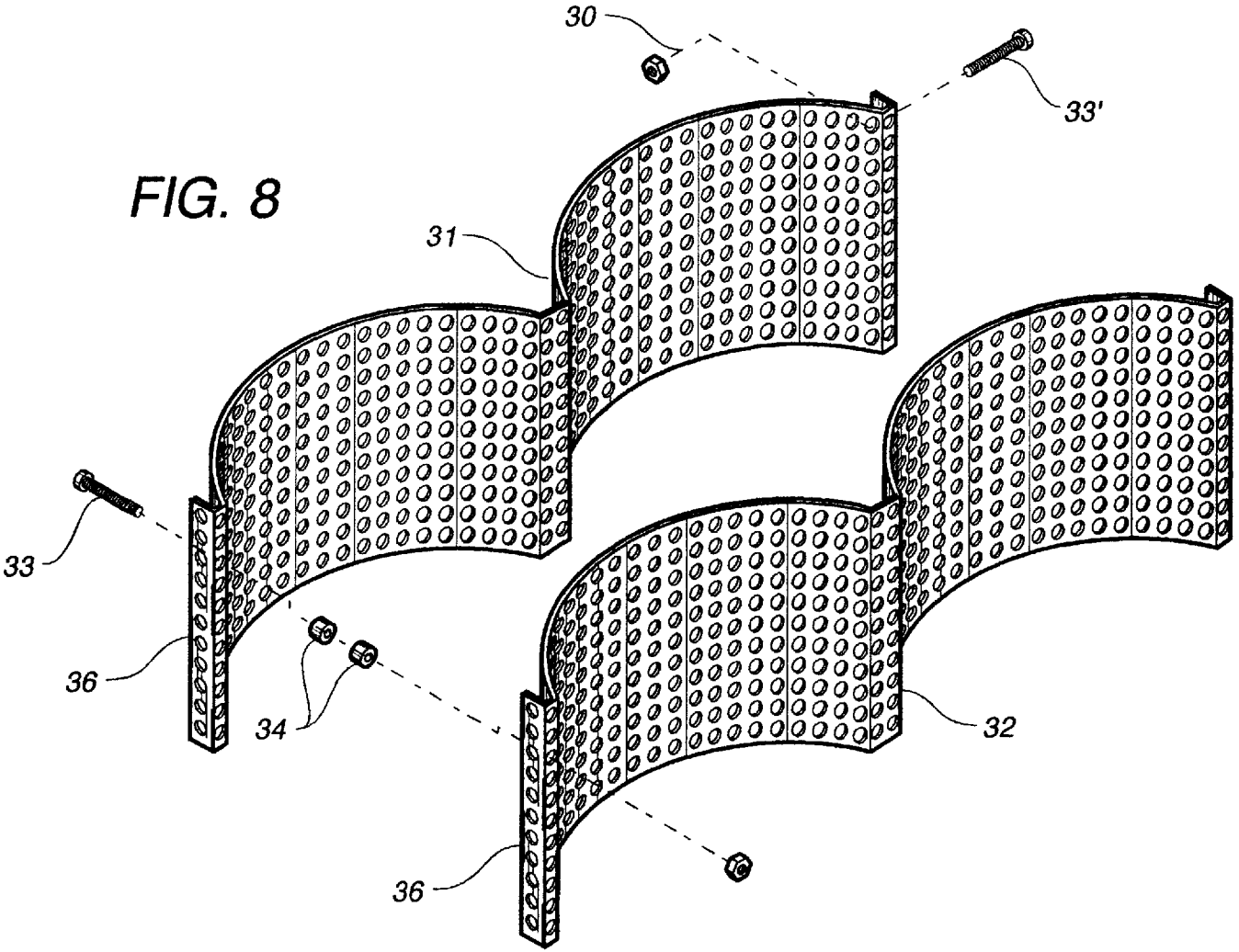
FIG. 8 is an exploded perspective view showing the construction of the visor shaping mold included in the device of FIG. 7.
Figure 9:
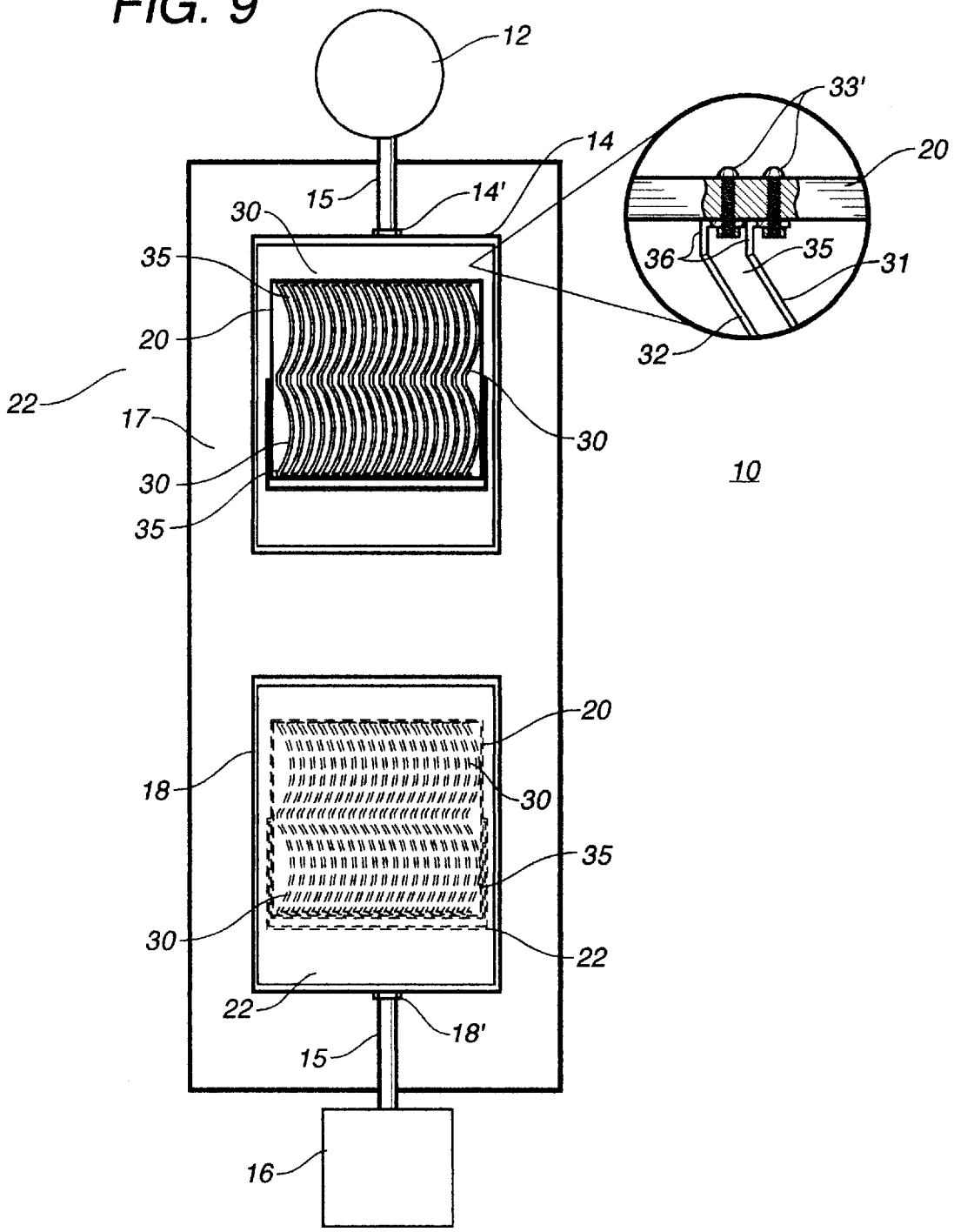
FIG. 9 is a plan view showing the construction of the shaping device of FIG. 7.
Figure 10:
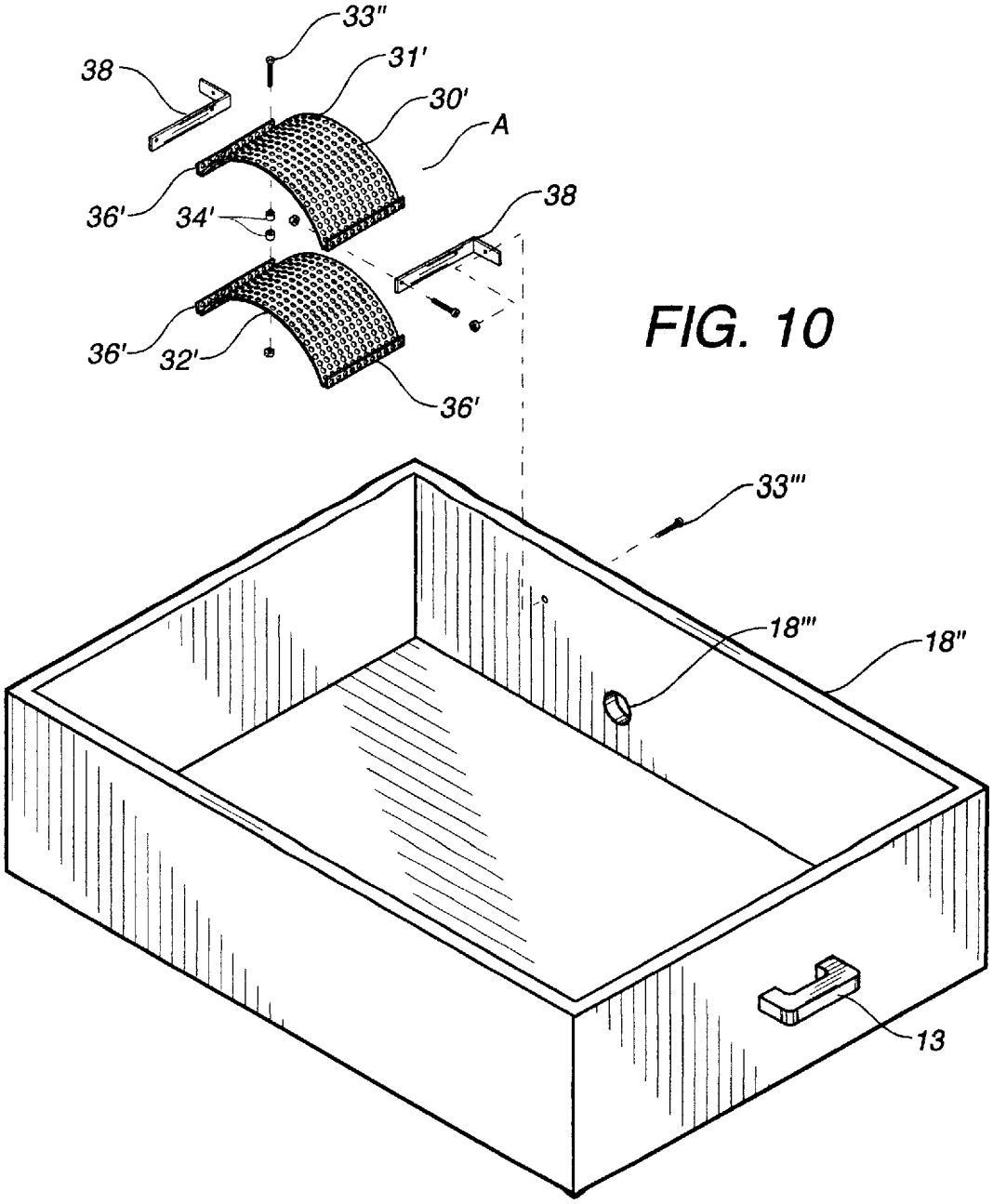
FIG. 10 is an exploded perspective view of a part of the shaping device in accordance with the third embodiment of the present invention, showing a cooling unit with a visor shaping mold.
Figure 11:
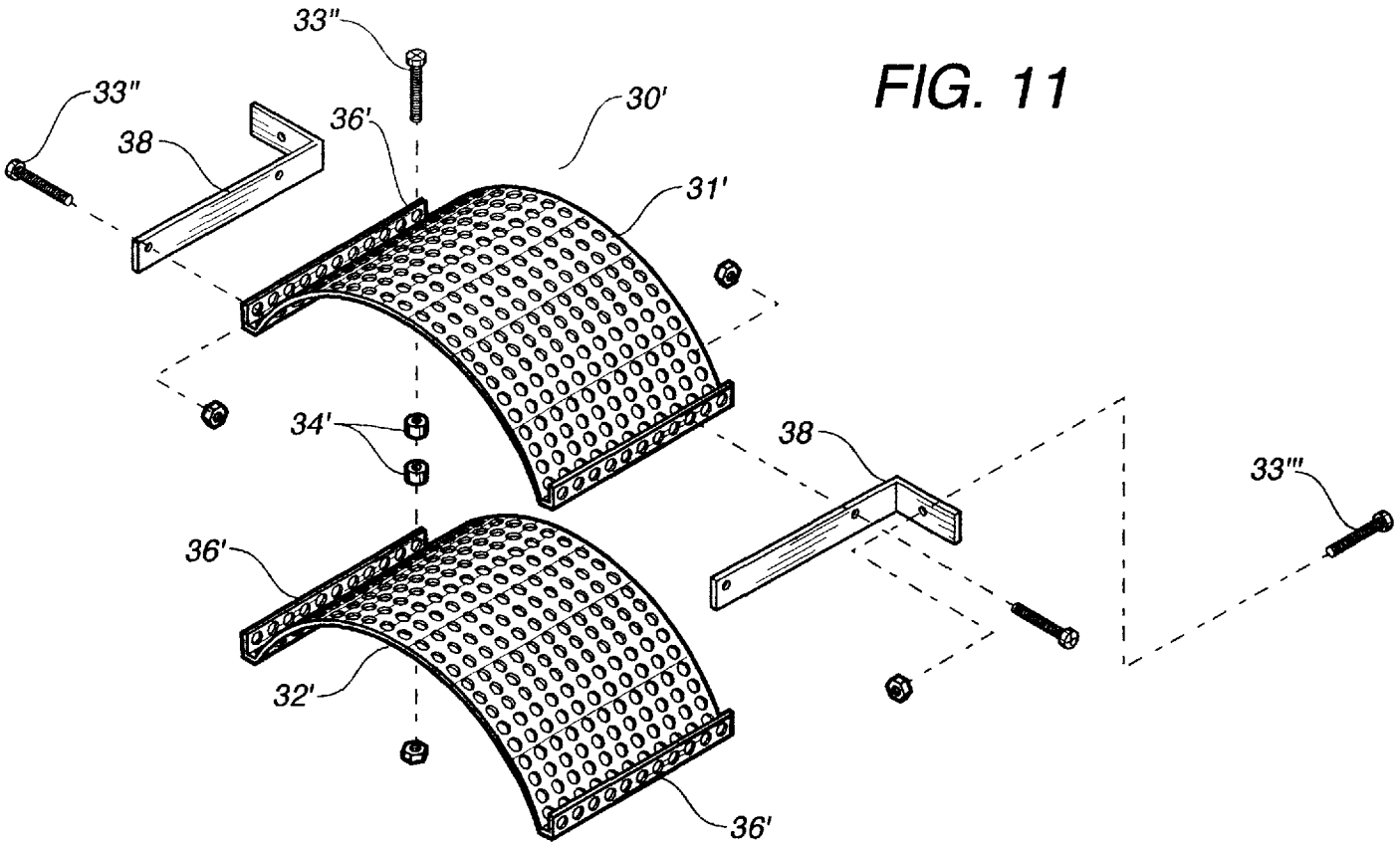
FIG. 11 is an exploded perspective view showing the construction of the visor shaping mold included in the device of FIG. 10.
Figure 12:
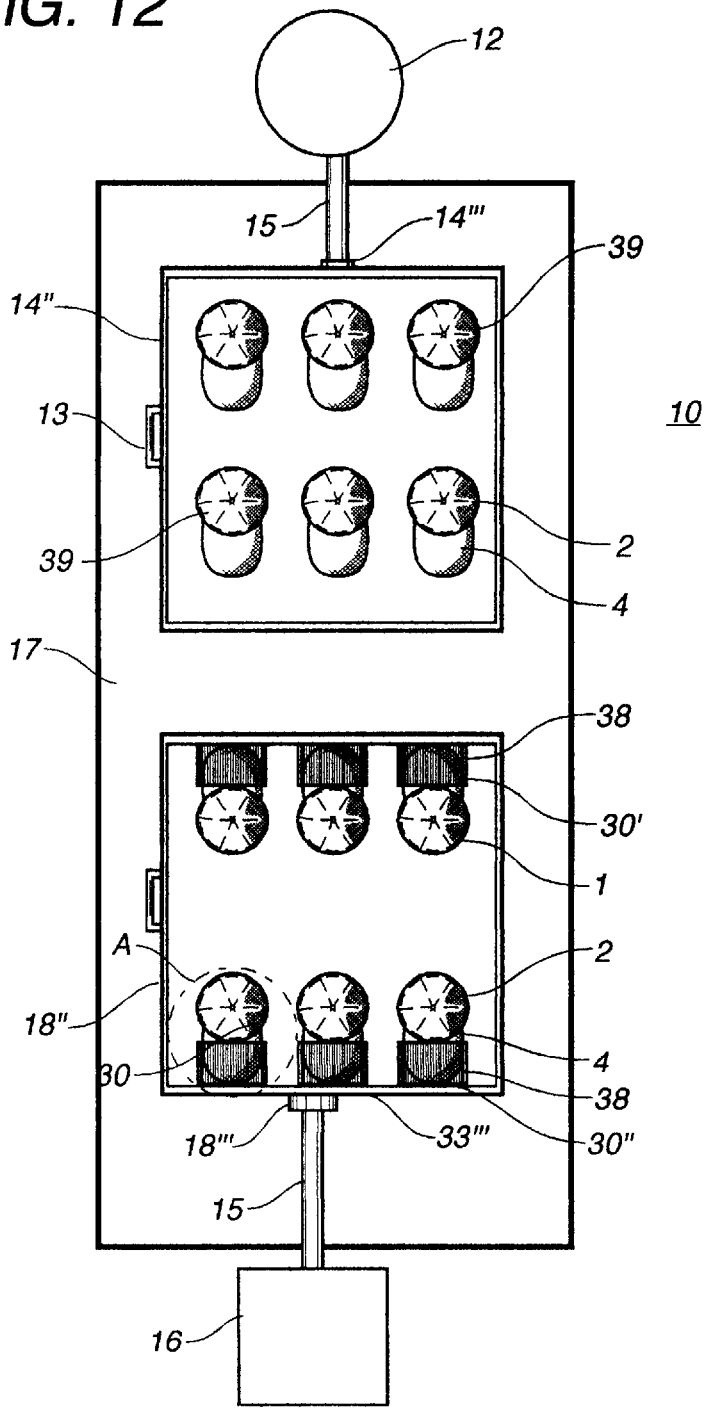
FIG. 12 is a plan view showing the construction of the shaping device of FIG. 10.
Figure 13:
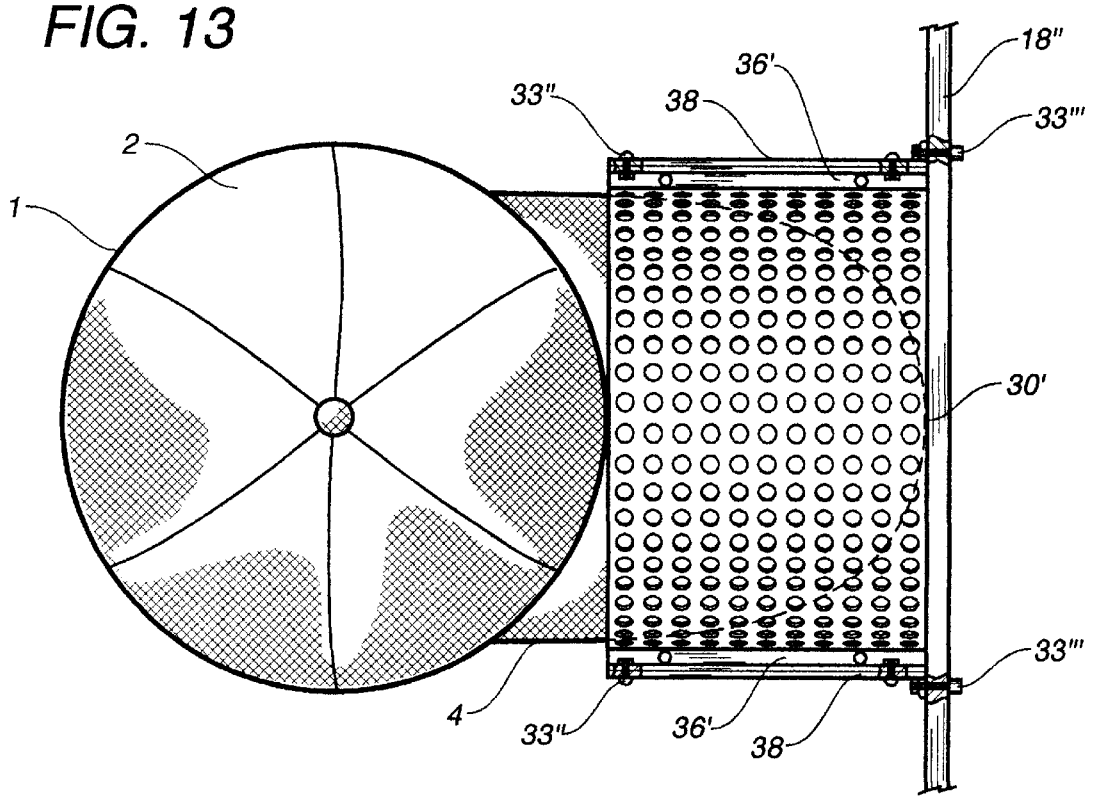
FIG. 13 is an enlarged view of the portion B of FIG. 12.
Figure 14:
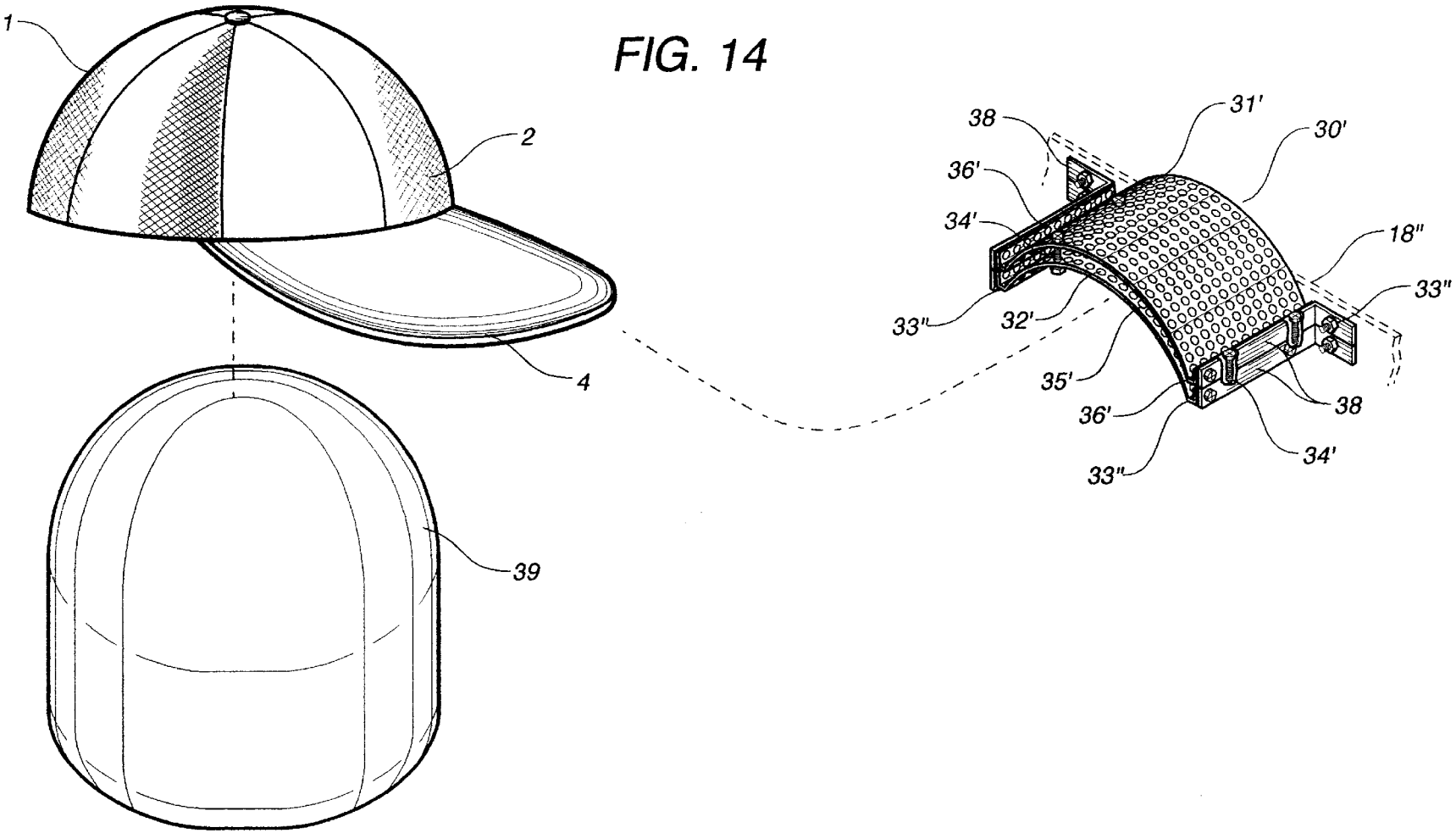
FIG. 14 is a perspective view showing crown and visor shaping molds included in the device of FIG. 10 with a cap being shaped by the two molds.

FIGS. 7 to 9 show the construction and operation of a shaping device in accordance with the second embodiment of the present invention. In the shaping device according to the second embodiment, the general shape of the device remains the same as in the primary embodiment, but only one case 20 is laid in each of the heating and cooling units 14 and 18 and each of the shaping molds 30 is altered as follows. That is, a plurality of visor shaping molds 30, individually comprised of first and second panels 31 and 32, are regularly arranged along the longitudinal direction in each of the cases 20. In each of the visor shaping molds 30, the first and second panels 31 and 32 are individually perforated and comprised of two curved parts, which are integrally formed abreast of each other and individually have a predetermined curvature. The first and second curved panels 31 and 32, which are flanged at each side edge, are assembled with each other at their flanged edges by a plurality of first set screws 33, with a plurality of spacers 34 being interposed between the flanged edges of the two panels 31 and 32 and being held by the screws 33. Therefore, the two panels 31 and 32 are spaced apart from each other while defining two curved gaps 35 abreast of each other between them. After the two panels 31 and 32 are assembled into a shaping mold 30, the shaping mold 30 is seated into and fixed to a case 20 at a predetermined position by a plurality of second set screws 33'. In the second embodiment, a plurality of supports 37 are exteriorly mounted to the bottom corners of each case 20. Each of the supports 37 is formed by curving a perforated panel into a predetermined curvature.

FIGS. 10 to 14 show the construction and operation of a shaping device in accordance with the third embodiment of the present invention. The shaping device according to the third embodiment is free from any case 20, but a plurality of visor shaping molds 30' are directly and regularly arranged in the cooling unit 18" and a plurality of crown shaping molds 39 are used for shaping the crowns 2 of caps 1 different from the primary and second embodiments. In the device of this invention, the heating unit 14" is open at its top and has a steam inlet 14"' at a side wall, thus being connected to the hot steam source 12. Meanwhile, the cooling unit 18" is open at its top and has a cool air inlet 18"' at a side wall, thus being connected to the cool air source 16. The two sources 12 and 16 respectively supply hot steam and cool air into the two units 14" and 18" through the inlets 14"' and 18"'. The visor shaping molds 30', individually comprised of upper and lower panels 31' and 32', are directly and regularly arranged in the cooling unit 18". The crown shaping molds 39 are separately prepared and are fitted into the crowns 2 of caps 1 during the heating and cooling processes of the device. In each of the visor shaping molds 30', the two panels 31' and 32' are individually perforated and curved into a predetermined curvature, and have a flange 36' at each side edge. The upper panel 31' is laid on top of the lower panel 32' prior to being assembled with each other by a plurality of set screws 33", with a plurality of spacers 34' being interposed between the two panels 31' and 32' and being held by the screws 33", thus forming a curved gap 35' between the two panels 31' and 32'. After the two panels 31' and 32' are assembled into a visor shaping mold 30', the shaping mold 30' is fixed in the cooling unit 18" at an appropriate position using a pluralty of brackets 38. In such a case, the brackets 38 are bolted to the overlapped flanges 36' of the visor shaping mold 30' prior to being mounted to the cooling unit 18" using a set screw 33'".

In the drawings, the reference numeral 11 denotes a lid used for detachably covering the top of each of the heating and cooling units, the numeral 13 denotes a handle exteriorly provided at the side wall of each of the heating and cooling units, the numeral 15 denotes a pipe connecting each of the two sources 12 and 16 to an associated unit, and the numeral 17 denotes a base frame supporting the two units in the device.

The operational effect of the shaping device according to the present invention will be described hereinbelow.

1. The shaping device according to the primary embodiment:

In the operation of the above device, two cases 20, individually having a row of visor shaping molds 30, are laid in the heating unit 14. Thereafter, the visors 4 of caps 1 are inserted into the curved gaps 35 of the visor shaping molds 30 of the two cases 20. In the present invention, the visors 4 are made of, for example, foam synthetic resin. However, it should be understood that the device of this invention may be preferably used for shaping visors which are made of hard paper, stiff cloth or thick leather.

After the caps 1 are completely set in the heating unit 14, the heating unit 14 is covered with a lid 11 prior to starting the hot steam source 12. Thus, the hot steam source 12 supplies hot steam into the heating unit 14 and heats the molds 30 along with the visors 4. The heated visors 4 are thermally shaped into the curvature formed by the two panels 31 and 32 of the molds 30.

In such a heating process, the hot steam has a temperature of about 100° C. and heats the molds for about 30 seconds. Since the visors 4 have a bubble structure, the visors 4 are quickly and effectively heated by the hot steam. In addition, the bubbles may be enlarged or shrunk in accordance with the curvature of the visors 4.

After the heating process, the cases 20 are moved into the cooling unit 18 prior to covering the cooling unit 18 using a lid 11. In such a case, the cases 20, with the handles 22, may be easily handled. After the two cases 20 are completely moved from the heating unit 14 into the cooling unit 18, the cool air source 16 is started, thus supplying cool air current into the cooling unit 18 and slowly cooling the heated visors 4 in the cases 20. Therefore, it is possible to set the curved configuration of the visors 4 while maintaining the desired curvature.

In such a cooling process, the cool air current has a temperature of about 18° C. and cools the molds for about 25 seconds. While the visors 4 are cooled as described above, the bubbles of the visors 4 are set while maintaining their enlarged or shrunk configurations.

After the cooling process, the lid 11 is removed from the cooling unit 18 prior to removing the caps 1 from the molds 30. In order to remove the caps 1 from the molds 30, the caps 1 are pulled from the molds 30 upwardly. The device thus provides the caps 1 with the visors 4 being shaped into the desired curvature.

2. The shaping device according to the second embodiment:

In the operation of the above device, the heating and cooling processes are performed in the same manner as in the primary embodiment, but two visors 4 are respectively inserted into the two curved gaps 35 of each mold 30. In addition, due to the supports 37 provided at the bottom corners of each case 20, the cases 20 are spaced apart from the bottom of each of the units 14 and 18 and allow both the hot steam and the cool air current to be more effectively circulated in an associated unit 14, 18. Therefore, the device of this embodiment somewhat improves the heating and cooling effect on the visors 4.

In the above operation, the hot steam has a temperature of about 100° C. and heats the molds for about 50 seconds, while the cool air current has a temperature of about 18° C. and cools the molds for about 45 seconds.

3. The shaping device according to the second embodiment:

In the operation of the above device, a plurality of crown shaping molds 39 are primarily fitted into the crowns 2 of the caps 1 prior to arranging the caps 1 in the heating unit 14". Thereafter, the top of the heating unit 14" is covered with a lid 11 and the hot steam source 12 is started. The hot steam source 12 thus supplies hot steam into the heating unit 14" and heats the caps 1 in the unit 14", thereby thermally softening the visors 4 and heating the crowns 2.

After the heating process, the lid 11 is removed from the top of the heating unit 14", thus allowing the hot steam to be effectively removed from the unit 14". Thereafter, the caps 1, with the visor shaping molds 39 being fitted into the crowns 2, are moved from the heating unit 14" into the cooling unit 18". In such a case, the caps 1 are set in the cooling unit 18" by inserting the thermally softened visors 4 into the curved gaps 35' of visor shaping molds 30' in the cooling unit 18". The cooling unit 18" is, thereafter, covered with a lid 11 prior to starting the cool air source 16, thus supplying cool air current into the cooling unit 18". The cool air current slowly cools the heated caps 1 in the cooling unit 18", thus setting the curved configuration of the visors 4 with a desired curvature formed by the curved gaps 35' of the visor shaping molds 30'. During the heating and cooling processes, the crown shaping molds 39 give an ironing effect to the crowns 2, thus smoothing out and tensioning the dome-shaped crowns 2.

In the above operation, the hot steam has a temperature of about 100° C. and heats the caps 1 for about 70 seconds, while the cool air current has a temperature of about 20° C. and cools the caps 1 for about 100 seconds. In addition, the visors 4, having the bubble structure, are quickly and effectively heated by the hot steam and the bubbles are enlarged or shrunk in accordance with the curvature of the visors 4.

After the cooling process, the lid 11 is removed from the cooling unit 18" prior to removing the caps 1 from the unit 18". In order to remove the caps 1 from the molds 30, the caps 1, with the crown shaping molds 39, are pulled from the molds 30' prior to removing the crown shaping molds 39 from the crowns 2. The device thus provides the caps 1 with both the visors 4 being shaped into the desired curvature and the crowns 2 being smoothed out.

As described above, the present invention provides a method and device for shaping the visors of caps. The method and device thermally shapes the visors of caps into a desired curvature using hot steam and sets the curved configuration of the visors using cool air current, thus providing caps with both the visors being set into the desired curvature and the crowns being smoothed out and tensioned. In such caps, the visors are free from the need of repeatedly shaping, thus being convenient to users and being preferably used as accessories for decorative purpose or showing a user's marked individuality.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of shaping the visor of a cap, comprising the steps of:

curving said visor into a predetermined curvature prior to heating the curved visor using hot steam having a temperature of about 100° C. for about 5–150 seconds; and cooling the heated visor using a cool air current having a temperature of about 5°–25° C. for about 10–150 seconds, thus setting the curved configuration of the visor.

2. A visor of a cap shaped into a predetermined curvature by curing the visor into th ecurvature prior to heating the curved visor using hot steam having a temperature of about 100° C. for about 5–150 seconds and by cooling the heated visor using a cool air current having a temperature of about 5°–25° C. for about 10–150 seconds so as to set the curved configuration of the visor.

* * * * *